US012710057B2

(12) United States Patent
Beers et al.

(10) Patent No.: US 12,710,057 B2
(45) Date of Patent: Aug. 18, 2026

(54) REVERSE DIRECTION BEARING COOLING FLOW PATH FOR A CABIN AIR COMPRESSOR

(71) Applicant: Hamilton Sundstrand Corporation, Charlotte, NC (US)

(72) Inventors: Craig M. Beers, Wethersfield, CT (US); Brent J. Merritt, Southwick, MA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 279 days.

(21) Appl. No.: 18/430,158

(22) Filed: Feb. 1, 2024

(65) Prior Publication Data

US 2025/0250990 A1 Aug. 7, 2025

(51) Int. Cl.

| | |
|---|---|
| ***F04D 29/58*** | (2006.01) |
| ***F04D 17/10*** | (2006.01) |
| ***F04D 25/06*** | (2006.01) |
| ***F04D 29/051*** | (2006.01) |

(52) U.S. Cl.

CPC ..... *F04D 29/584* (2013.01); *F04D 17/10* (2013.01); *F04D 25/06* (2013.01); *F04D 29/5806* (2013.01); *F04D 29/051* (2013.01)

(58) Field of Classification Search

CPC ..... F04D 29/584; F04D 29/051; F04D 17/10; F04D 25/06; F04D 29/5806

See application file for complete search history.

(56) References Cited

U.S. PATENT DOCUMENTS

| | | | | |
|---|---|---|---|---|
| 5,113,670 | A | 5/1992 | Mcauliffe et al. | |
| 7,633,193 | B2 * | 12/2009 | Masoudipour | H02K 9/197 310/59 |
| 8,496,533 | B2 | 7/2013 | Beers et al. | |
| 9,057,283 | B2 | 6/2015 | Gee et al. | |
| 9,243,643 | B2 | 1/2016 | Beers et al. | |
| 10,160,546 | B2 | 12/2018 | Beers et al. | |

(Continued)

FOREIGN PATENT DOCUMENTS

| | | | | |
|---|---|---|---|---|
| CN | 116867975 A | * | 10/2023 | F04D 29/057 |
| WO | 2018030657 A1 | | 2/2018 | |

OTHER PUBLICATIONS

Extended European Search Report for EP Application No. 25155565.2, dated Jun. 10, 2025, 8 pages.

*Primary Examiner* — Nathan C Zollinger

(74) *Attorney, Agent, or Firm* — Kinney & Lange, P.A.

(57) ABSTRACT

A compressor includes a compressor rotor and a motor disposed about a common axis. The motor includes a rotor shaft coupled to the compressor rotor and configured to drive the compressor rotor; a thrust shaft disposed at an opposite end of the motor from the rotor shaft; a tie rod disposed on the common axis and extending through the rotor shaft, thrust shaft, and the compressor rotor; a first journal bearing disposed about the rotor shaft and concentrically about the common axis to radially support the rotor shaft; a journal bearing support disposed concentrically about the first journal bearing; and a cooling fluid inlet disposed adjacent to the bearing support and in fluid communication with the first journal bearing. The rotor shaft includes a plurality of orifices. The tie rod axially retains the compressor rotor at a forward end and the motor at an aft end.

15 Claims, 3 Drawing Sheets

(56) References Cited

U.S. PATENT DOCUMENTS

| | | | | |
|---|---|---|---|---|
| 10,724,544 | B2 | 7/2020 | Graham et al. | |
| 11,143,203 | B2 | 10/2021 | Merritt et al. | |
| 11,225,978 | B2 * | 1/2022 | Merritt | F04D 29/051 |
| 11,261,880 | B2 * | 3/2022 | Merritt | F04D 29/4206 |
| 11,365,742 | B2 | 6/2022 | Pal et al. | |
| 11,668,324 | B2 * | 6/2023 | Merritt | F04D 25/082 417/369 |
| 11,852,166 | B2 | 12/2023 | Merritt et al. | |
| 12,234,838 | B2 * | 2/2025 | Kim | F04D 29/28 |
| 2008/0168796 | A1 | 7/2008 | Masoudipour et al. | |
| 2012/0064815 | A1 * | 3/2012 | Beers | F04D 29/057 454/71 |
| 2012/0207585 | A1 * | 8/2012 | Anderson | F04D 25/082 415/116 |
| 2024/0301895 | A1 * | 9/2024 | Kim | F04D 17/10 |

* cited by examiner

REVERSE DIRECTION BEARING COOLING FLOW PATH FOR A CABIN AIR COMPRESSOR

BACKGROUND

The present disclosure is directed generally to an air compressor and, more particularly, to structure and methods for cooling a motor and bearings of a compressor suitable for providing pressurized air to an aircraft environmental control system.

As an alternative to bleed air, a separate air compressor, such as a cabin air compressor, can be used to provide pressurized air to an aircraft environmental control system. Using a separate air compressor can reduce both the overall complexity and the need for maintenance of the environmental control system. Using a separate air compressor can also improve fuel efficiency of the environmental control system.

SUMMARY

In one aspect, a compressor includes a compressor rotor and a motor disposed about a common axis. The motor includes a rotor shaft coupled to the compressor rotor and configured to drive the compressor rotor; a thrust shaft disposed at an opposite end of the motor from the rotor shaft; a tie rod disposed on the common axis and extending through the rotor shaft, thrust shaft, and the compressor rotor; a first journal bearing disposed about the rotor shaft and concentrically about the common axis to radially support the rotor shaft; a journal bearing support disposed concentrically about the first journal bearing; and a cooling fluid inlet disposed adjacent to the bearing support and in fluid communication with the first journal bearing. The rotor shaft includes a plurality of orifices. The tie rod axially retains the compressor rotor at a forward end and the motor at an aft end.

Another aspect relates to a method for cooling a compressor having a compressor rotor driven by a motor, wherein the motor and compressor rotor are disposed on a common axis with the compressor rotor arranged forward of the motor. The method includes providing a cooling stream to an inlet disposed at a forward end of the motor and dividing the cooling stream into: (1) a first cooling stream directed to a first journal bearing supporting a rotor shaft coupled to the compressor rotor and (2) a rotor cooling stream directed to an inner diameter of the rotor shaft.

The present summary is provided only by way of example, and not limitation. Other aspects of the present disclosure will be appreciated in view of the entirety of the present disclosure, including the entire text, claims and accompanying figures.

Figure 1:
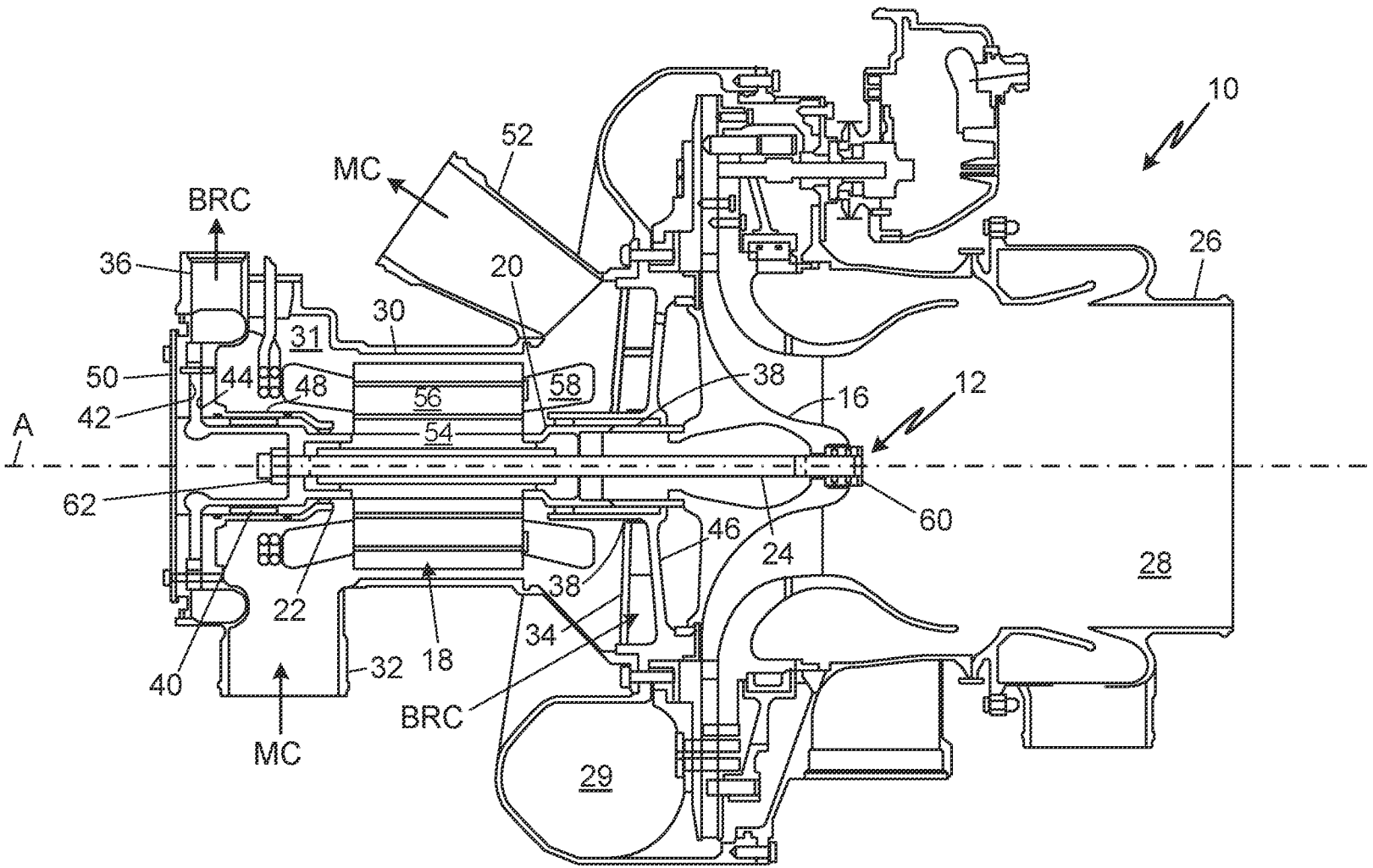
FIG. 1 is a simplified cross-sectional view of an example of a cabin air compressor.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The present invention includes cooling structures and architectures for motor-driven compressors, such as a cabin air compressor used to provided pressurized air to an environmental control system (ECS) of an aircraft. The present invention includes a reverse direction bearing cooling flow path to provide the coolest, highest pressure air to a journal bearing of a rotor shaft driving a compressor rotor, which is the most highly loaded rotor of the system. Advantageously, the bulk of cooling fluid through the compressor motor is discharged downstream of the cabin air compressor body.

FIG. 1 is a simplified cross-sectional view of air compressor 10. Compressor 10 can be used to provide pressurized air to an aircraft ECS. Compressor 10 is configured to intake ambient air exterior to the aircraft and increase the ambient pressure, generating compressed air, which can be delivered to a passenger cabin of the aircraft. Compressor 10 includes shaft assembly 12 and static assembly 14. Shaft assembly 12 includes, among other components not specifically identified herein, compressor rotor 16, motor 18, rotor shaft 20, thrust shaft 22, and tie rod 24. Static assembly 14 includes, among other components not specifically identified herein, compressor housing 26, compressor inlet 28, air outlet 29, motor housing 30, motor cooling inlet 32, bearing and rotor cooling inlet 34, cooling air outlet 36, journal bearings 38, 40, thrust bearings 42, 44, bearing supports 46, 48, end plate 50, and cooling air outlet 52. Shaft assembly 12 is centered on axis A-A with tie rod 24 extending on axis A-A and compressor rotor 16 and motor 18 attached thereto at opposite axial ends. For purposes of identifying the relative location of components described herein, end plate 50 is positioned at an axially aftmost end of compressor 10 and compressor inlet 28 is positioned at an axially forwardmost end of compressor 10.

Compressor inlet 28 can be fluidly connected to a source of ambient air (e.g., ram air intake). Air outlet 29 can be fluidly connected to an ECS of an aircraft. In operation, motor 18 drives the rotation of compressor rotor 16 via rotor shaft 20. Compressor rotor 16 is an impeller or radial compressor. Compressor rotor 16 directs air through compressor housing 26 when compressor rotor 16 is rotated by motor 18. Specifically, a flow of air enters compressor housing 26 through inlet 28 and is pumped radially outward by compressor rotor 16, pressurizing the flow of air. The pressurized flow of air exits compressor 10 through air outlet 29 for delivery to, for example, an ECS of the aircraft.

Motor 18 is an electric motor as known in the art. Motor 18 includes rotor 54 and stator 56. Stator 56 is disposed concentrically about rotor 54 and includes windings 58. Motor 18 is housed in motor housing 30, which defines cavity 31 around stator windings 58, to which a cooling air can be provided. Rotor 54, which can be an assembly of permanent magnets or electromagnets as known in the art, rotates about axis A-A. A forward end of rotor 54 is coupled to rotor shaft 20. An aft end of rotor 54 is coupled to thrust shaft 22. Rotor shaft 20 is coupled to compressor rotor 16 to drive rotation of compressor rotor 16. Thrust shaft 22 includes axially extending portion 22*a*, radially extending thrust runner or disk 22*b*, and radially extending retention portion 22*c*.

Tie rod 24 is configured to axially preload and provide an axial clamping force to components of shaft assembly 12, including compressor rotor 16 and motor 18, including rotor shaft 20 and thrust shaft 22. Tie rod 24 is centered on axis A-A and extends through each of compressor rotor 16, motor 18, rotor shaft 20 and thrust shaft 22. The ends of tie rod 24 are attached to retention nuts 60 and 62, configured to axially restrain the components of shaft assembly 12. Retention nut 60 is disposed at a forward end of tie rod 24 adjacent to compressor rotor 16. Retention nut 62 is disposed at an aft end of tie rod 24 adjacent to thrust shaft 22 (radially extending retention portion 22*c*). Tie rod support (TRS) 64 can be provided within rotor shaft 20 to support tie rod 24, limit tie rod vibration, and prevent tie rod 24 from achieving a detrimental bending mode. TRS 64 is a generally annular support disposed about tie rod 24 and configured to interface with each of tie rod 24 and an inner diameter surface of rotor shaft 20.

Shaft assembly 12 is radially supported within housings 26 and 30 by journal bearings 38 and 40 and bearing supports 46 and 48. Shaft assembly 12 is axially restrained within housings 26 and 30 by thrust bearings 42 and 44, bearing support 48, and end plate 50. Journal bearings 38 and 40 are concentrically disposed about axis A-A. Journal bearing 38 is disposed radially between rotor shaft 20 and an axially extending portion of bearing support 46 coupled to compressor housing 26. Journal bearing 40 is disposed radially between axially extending portion 22*a* of thrust shaft 22 and an axially extending portion of bearing support 48 coupled to motor housing 30. Thrust bearings 42 and 44 are disposed on opposite sides of thrust runner 22*b* of thrust shaft 22. Thrust bearings 42 are disposed axially between end plate 50 and thrust runner 22*b* of thrust shaft 22 to axially restrain shaft assembly 12.

Motor 18, journal bearings 38, 40, and thrust bearings 42, 44 are cooled with cooling air. A motor cooling stream MC can be drawn from compressor inlet 28 at outlet 66 and provided to motor cooling inlet 32. The motor cooling stream MC can be delivered to motor cavity 31 defined by motor housing 30. The motor cooling stream MC can exit compressor 10 via cooling air outlet 52. Cooling air outlet 52 can be configured to couple to an exhaust duct for discharge from the aircraft.

A bearing and rotor cooling stream BRC can be drawn from downstream of (compressor) air outlet 29 and provided to bearing and rotor cooling inlet 34. In some examples, a heat exchanger (not shown) can be disposed upstream of rotor cooling inlet 34 and downstream of air outlet 29 to cool air in the bearing and rotor cooling stream BRC. The bearing and rotor cooling stream BRC cools thrust bearings 42, 44, journal bearings 38, 40, and motor rotor 54.

Figure 2:
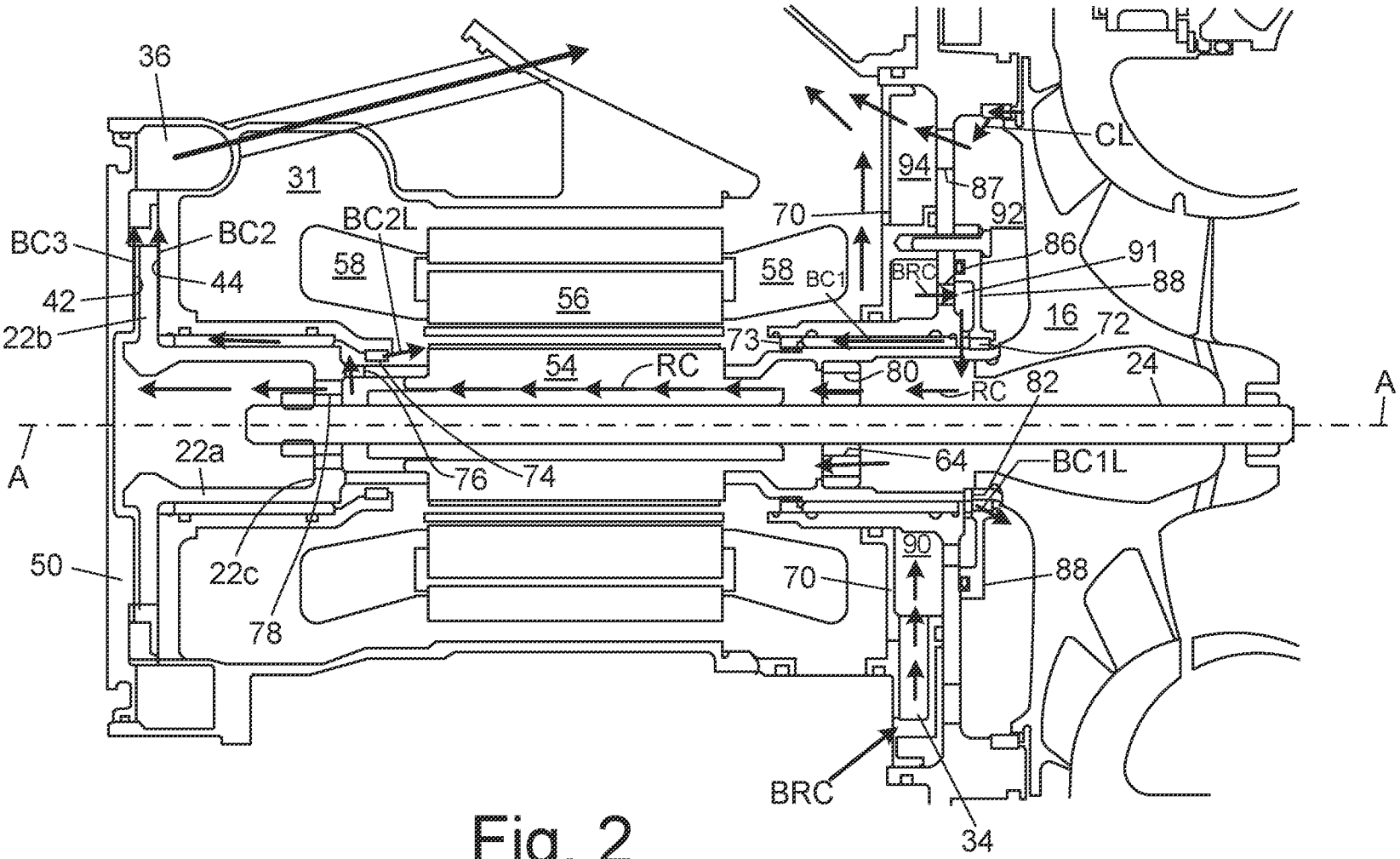
FIG. 2 is a detailed view of portion 2 of FIG. 1, illustrating cooling fluid flow through the cabin air compressor.

FIG. 2 shows portion 2 of FIG. 1, illustrating cooling fluid flow through compressor 10. FIG. 2 shows compressor rotor 16, motor 18, rotor shaft 20, thrust shaft 22 (axially extending portion 22*a*, thrust runner 22*b*, and retention portion 22*c*), tie rod 24, motor housing 30, bearing and rotor cooling inlet 34, cooling air outlet 36, journal bearings 38 and 40, thrust bearings 42 and 44, bearings supports 46 and 48, end plate 50, motor rotor 54, motor stator 56 with windings 58, TRS 64, duct 68, heat shield 70, seals 72, 73, and 74, thrust shaft orifices 76 and 78, TRC orifices 80, rotor shaft orifices 82, backside 84 of compressor rotor 16, openings 86, 87, seal plate 88, and cavities 90, 92, and 94.

As illustrated in FIG. 2, bearing and rotor cooling stream BRC enters compressor 10 at bearing and rotor cooling inlet 34 at a forward end of motor 18 to provide direct cooling to journal bearing 38. The bearing and rotor cooling stream BRC is split upstream or forward of journal bearing 38 into bearing cooling stream BC1 and rotor cooling stream RC. Bearing cooling stream BC1 is directed through journal bearing 38. Rotor cooling stream RC is directed through an inner diameter of motor rotor 54. Rotor cooling stream RC is divided at thrust shaft into bearing cooling streams BC2 and BC3. Bearing cooling stream BC2 is directed through journal bearing 40 and thrust bearing 44. Bearing cooling stream BC3 is directed through thrust bearing 42 before joining bearing cooling stream BC2 in cooling air outlet 36.

A flow path of rotor cooling stream RC extends from rotor shaft 20 to thrust shaft 22 in an axial forward to aft direction. A flow path of bearing cooling stream BC1 extends through duct 68, bearing support 46, journal bearing 38, and motor cavity 31. Bearing cooling stream BC1 extends through journal bearing 38 in an axial forward to aft direction. A flow path of bearing cooling stream BC2 extends through journal bearing 40 and thrust bearing 44 in an axial forward to aft direction and radially outward direction, respectively. A flow path of bearing cooling stream BC3 extends through thrust bearing 42 in a radially outward direction before joining bearing cooling stream BC2.

Bearing and rotor cooling inlet 34 can be disposed between bearing support 46 and heat shield 70 between motor 18 and compressor rotor 16. Bearing support 46 is an annular structure including an axially extending portion supporting journal bearing 38 and radially extending portion coupled to compressor housing 26. Heat shield 70, together with bearing support 46, can define an annular cavity 90 disposed radially outward of journal bearing 38. Bearing cooling stream BC1 is provided to journal bearing 38 via opening 86 in bearing support 46. Bearing and rotor cooling stream BRC can enter a cavity 91 defined by seal plate 88 and a radially extending portion of bearing support 46. Seal plate 88 supports seal 72. Cavity 91 is open to a forward end of journal bearing 38 and inner diameter of rotor shaft 20. Bearing and rotor cooling stream BRC is split from cavity 91 between bearing cooling stream BC1 and rotor cooling stream RC.

Bearing cooling stream BC1 is provided to a forward end of journal bearing 38 and flows axially in a forward to aft direction through journal bearing 38. Bearing cooling stream BC1 flows in the same direction as airflow through compressor inlet 28. Seal 72 is disposed axially forward of journal bearing 38 (i.e., downstream of bearing cooling stream BC1 through journal bearing 38) between rotor shaft 20 and seal plate 88. Seal 72 is configured to maintain flow of bearing cooling stream BC1 through journal bearing 38 and to limit leakage of bearing cooling stream BC1 into cavity 92 defined between bearing support 46 and compressor rotor 16. Seal 73 is located aft of journal bearing 38 between rotor shaft 20 and bearing support 46. Seals 72 and 73 maintain pressure in journal bearing 38 to minimize a pressure drop across journal bearing 38, which improves the lifetime and reliability of journal bearing 38. Seal 73 provides clearance for bearing cooling stream BC1 to pass through journal bearing 38 and into motor cavity 31. Seals 72 and 73 can be, for example, labyrinth seals. Leakage through seal 72 enters cavity 92 wherein it can combine with compressor leakage CL from compressor rotor 16. Leaked bearing cooling fluid BC1 and compressor leakage CL can be exhausted through opening 87 in bearing support 46 to cavity 94 and discharged, e.g., via cooling air outlet 52.

Bearing cooling stream BC1 exits the aft end of journal bearing 38 to motor cavity 31. Bearing cooling stream BC1 can flow around end turns (windings) 58 of stator 56 to provide additional motor cooling. Because bearing cooling stream BC1 bypasses thrust bearings 42 and 44, journal bearing 40, and motor rotor 54, bearing cooling stream BC1 is cooler when it enters journal bearing 38 and can retain some cooling capacity when it enters motor cavity 31. The additional cooling capacity in motor cavity 31 is beneficial to cooling end turn (windings) 58 of stator 56. Ultimately, bearing cooling stream BC1 can exit compressor 10 via cooling air outlet 52 (shown in FIG. 1).

Rotor cooling stream RC exits cavity 91 through a plurality of orifices 82 in rotor shaft. Orifices 82 are disposed at a forward end of rotor shaft 20, axially forward of journal bearing 38. Orifices 82 can be circumferentially arranged about rotor shaft 20 and can extend through rotor shaft 20 generally perpendicular to axis A-A.

Rotor cooling stream RC flows axially through an inner diameter of motor rotor 18, including rotor shaft 20 and thrust shaft 22 in an axial forward to aft direction. Rotor cooling stream RC passes through orifices 80 in TRS 64, which is disposed in rotor shaft 20. Orifices 80 can be circumferentially arranged about TRS 64 and can extend through TRS 64 substantially parallel to axis A-A.

Rotor motor cooling stream RC splits at thrust shaft 22 into bearing cooling streams BC2 and BC3. A portion of rotor cooling stream RC passes through orifices 76 in axially extending portion 22*a* of thrust shaft 22 toward journal bearing 40 and a portion of rotor cooling stream RC passes through orifices 78 in retention portion 22*c* of thrust shaft 22 toward an aft end of thrust shaft 22 and thrust bearing 42.

A plurality of orifices 76 are provided at an axial location forward of journal bearing 40 (upstream of flow of bearing cooling stream BC2 through journal bearing 40). Orifices 76 are circumferentially arranged about thrust shaft 22 and can extend through thrust shaft 22 generally perpendicular to axis A-A. A portion of rotor cooling stream RC exits the inner diameter motor rotor 54 and is directed through orifices 76 to an outer diameter of thrust shaft 22.

Seal 74 is disposed at a location axially forward of orifices 76 (i.e., upstream of bearing cooling stream BC2 through journal bearing 40) between thrust shaft 22 and bearing support 48. Seal 74 is configured to limit leakage of bearing cooling stream BC2 to a motor gap and motor cavity 31. Seal 74 maintains pressure in journal bearing 40 to minimize a pressure drop across journal bearing 40, which improves the lifetime and reliability of journal bearing 40. Seal 74 can be, for example, a labyrinth seal. Some amount of leakage across seal 74 can occur as shown by bearing cooling stream BC2L. Leakage cooling stream BC2L is discharged into motor cavity 31 adjacent motor cooling inlet 32 and exits motor cavity 31 via cooling air outlet 52. The large majority of bearing cooling stream BC2 is directed through orifices 76 to journal bearing.

Bearing cooling stream BC2 passes through journal bearing 40 in an axial forward to aft direction toward thrust runner 22*b* wherein bearing cooling stream BC2 turns to pass through thrust bearing 44. Bearing cooling stream BC2 passes through thrust bearing 44 in a radially outward direction toward cooling air outlet 36.

Bearing cooling stream BC3 is received from orifices 78. Orifices 78 are circumferentially disposed about retention portion 22*c* of thrust shaft 22 and can extend substantially parallel to axis A-A. Bearing cooling stream BC3 passes through thrust bearing 42 in a radially outward direction. Bearing cooling streams BC2 and BC3 combine downstream of thrust bearings 42 and 44 in cooling air outlet for discharge.

Figure 3:
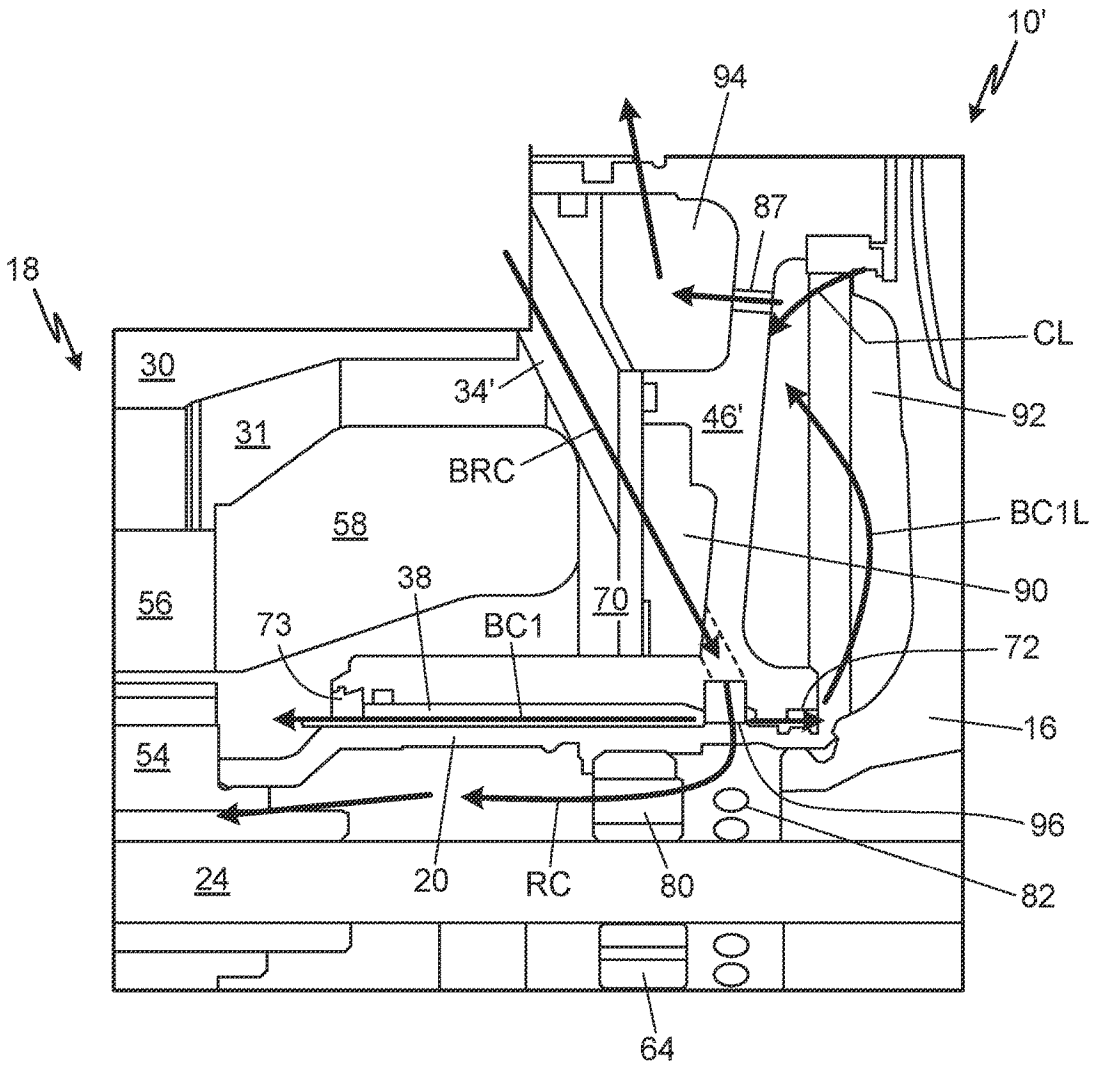
FIG. 3 is a detailed view of a modified assembly of the cabin air compressor of FIG. 1 for a portion of a bearing cooling flow.

FIG. 3 is a detailed view of a modified inlet assembly compressor 10'. FIG. 3 shows compressor rotor 16, motor 18, tie rod 24, motor housing 30, rotor shaft 20, bearing and rotor cooling inlet 34', journal bearing 38, bearing support 46', motor rotor 54, stator 56, windings 58, heat shield 70, seals 72 and 73, orifices 80 and 82, opening 87, cavities 90, 92, and 94, openings 96, bearing and rotor cooling stream BRC, bearing cooling stream BC1, rotor cooling stream RC, compressor leakage CL, and bearing cooling stream leakage BC1L. Compressor 10' is substantially similar to compressor 10 of FIG. 2 with the exception of modifications to the inlet assembly described herein. Specifically, compressor 10' includes a modification to bearing support 46 as described further herein.

As shown in FIG. 3, bearing and rotor cooling stream BRC can enter compressor 10' substantially between motor 18 and compressor rotor 16. Specifically, bearing and rotor cooling stream BRC can pass through bearing and rotor cooling inlet duct 34 disposed between motor 18 and compressor rotor 16. Inlet 34' opens to cavity 90' defined between heat shield 70 and support shaft 46'. Bearing support 46' can include one or more openings 96 at a radially inner diameter opening to cavity 90', journal bearing 38, and an outer diameter of rotor shaft 20. Specifically, the one or more openings 96 can be axially aligned with orifices 82 of rotor shaft 20 to direct a portion of bearing and rotor cooling stream BRC to the inner diameter of rotor shaft 20. For example, opening 96 can be a circumferential slot provided to an inner diameter of bearing support 46' with a plurality of orifices (shown in phantom) opening to cavity 90, although other configurations are contemplated.

Bearing and rotor cooling stream BRC is split at openings 96 between bearing cooling stream BC1 and rotor cooling stream RC. As described with respect to FIG. 2, a portion of bearing and rotor cooling stream BRC passes through orifices 82 of rotor shaft to cool the inner diameter of motor rotor 54. Bearing cooling stream BC1 passes through journal bearing 38.

Other components shown but not further described can be substantially the same or similar to those described with respect to FIG. 2. The arrangement and configuration of bearing and rotor cooling inlet 34 is a simplification and not intended to limit the structure to a particular design.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

DISCUSSION OF POSSIBLE EMBODIMENTS

The following are non-exclusive descriptions of possible embodiments of the present invention.

A compressor includes a compressor rotor configured to compress air and a motor for driving the compressor rotor. The motor and compressor rotor are disposed about a common axis. The motor includes a rotor shaft coupled to the compressor rotor and configured to drive the compressor rotor; a thrust shaft disposed at an opposite end of the motor from the rotor shaft; a tie rod disposed on the common axis and extending through the rotor shaft, thrust shaft, and the compressor rotor; a first journal bearing disposed concentrically about the common axis to radially support the rotor shaft; a journal bearing support disposed concentrically about the first journal bearing; and a cooling fluid inlet disposed adjacent to the bearing support and in fluid communication with the first journal bearing. The rotor shaft includes a plurality of orifices. The tie rod axially retains the compressor rotor at a forward end and the motor at an aft end. The first journal bearing is disposed about the rotor shaft.

The compressor of the preceding paragraph can optionally include, additionally and/or alternatively, any one or more of the following features, configurations and/or additional components:

An embodiment of the foregoing compressor can further include an annular heat shield, the annular heat shield and bearing support defining a first cavity therebetween, the first cavity open to the cooling fluid inlet.

In an embodiment of the compressor of any of the preceding paragraphs, the bearing support can include an opening at an inner diameter opening to the first cavity and the journal bearing and the plurality of orifices of the rotor shaft.

In an embodiment of the compressor of any of the preceding paragraphs, the opening can be disposed adjacent to a forward end of the first journal bearing.

In an embodiment of the compressor of any of the preceding paragraphs, the bearing support can include a seal plate disposed between the compressor rotor and a radially extending portion the bearing support, the seal plate and the radially extending portion of the bearing support defining a second cavity therebetween, the second cavity open to each of the journal bearing, the plurality of orifices of the rotor shaft, and the first cavity.

In an embodiment of the compressor of any of the preceding paragraphs, the second cavity can be disposed adjacent to a forward end of the first journal bearing.

An embodiment of the compressor of any of the preceding paragraphs can further include a first bearing cooling flow path extending axially from a forward end of the first journal bearing to an aft end of the first journal bearing.

In an embodiment of the compressor of any of the preceding paragraphs, the cooling fluid inlet can be in fluid communication with an inner diameter of the rotor shaft.

In an embodiment of the compressor of any of the preceding paragraphs, the bearing support can be configured to divide a cooling fluid received in the cooling fluid inlet between a bearing cooling stream and a rotor cooling stream, the bearing cooling stream having a flow path extending through the first journal bearing, the rotor cooling stream having a flow path extending through an inner diameter of the rotor shaft.

An embodiment of the compressor of any of the preceding paragraphs can further include a tie rod support disposed between the tie rod and the rotor shaft, the tie rod support including a plurality of orifices configured to receive the rotor cooling stream.

In an embodiment of the compressor of any of the preceding paragraphs, the thrust rotor can include a plurality of radially extending orifices configured to receive a first portion of the rotor cooling stream.

In an embodiment of the compressor of any of the preceding paragraphs, the thrust rotor can include a plurality of axially extending orifices configured to receive a second portion of the rotor cooling stream.

In an embodiment of the compressor of any of the preceding paragraphs, the compressor can further include a second journal bearing disposed concentrically about the common axis and the thrust shaft to radially support the thrust shaft, wherein the plurality of radially extending orifices is located forward of the second journal bearing and wherein the second journal bearing is disposed to receive the first portion of the rotor cooling stream, wherein the first portion of the rotor cooling stream is a second bearing cooling stream.

An embodiment of the compressor of any of the preceding paragraphs can further include first and second thrust bearings disposed adjacent to the thrust shaft to axially support a radially extending thrust runner of the thrust shaft, the first and second thrust bearings disposed on opposite sides of the thrust runner.

In an embodiment of the compressor of any of the preceding paragraphs, the first thrust bearing can be disposed to receive the second portion of the rotor cooling stream and the second thrust bearing is disposed to receive the first portion of the rotor cooling stream from the second journal bearing, wherein the first portion of the rotor cooling stream is a third bearing cooling stream.

An embodiment of the compressor of any of the preceding paragraphs can further include a cooling fluid outlet disposed adjacent to the first and second thrust bearings and configured to receive the first and second portions of the rotor cooling stream from the first and second thrust bearings.

In an embodiment of the compressor of any of the preceding paragraphs, flow paths of the first and second bearing cooling streams and the rotor cooling stream can extend axially from a forward to aft direction through the compressor.

Another aspect relates to a method for cooling a compressor having a compressor rotor driven by a motor, wherein the motor and compressor rotor are disposed on a common axis with the compressor rotor arranged forward of the motor. The method includes providing a cooling stream to an inlet disposed at a forward end of the motor and dividing the cooling stream into: (1) a first cooling stream directed to a first journal bearing supporting a rotor shaft coupled to the compressor rotor and (2) a rotor cooling stream directed to an inner diameter of the rotor shaft.

The method of the preceding paragraph can optionally include, additionally and/or alternatively, any one or more of the following features, configurations, additional components, and/or steps:

An embodiment of the foregoing method can further include providing a first portion of the rotor cooling stream to a second journal bearing, the second journal bearing supporting a thrust shaft coupled to an aft end of the motor opposite the rotor shaft.

An embodiment of the foregoing method can further include providing the first portion of the rotor cooling stream to a first thrust bearing disposed downstream of the second journal bearing, providing a second portion of the rotor cooling stream to a second thrust bearing, and combining the first and second portions of the rotor stream in a cooling outlet downstream of the first and second thrust bearings.

The invention claimed is:

1. A compressor comprising:

a compressor rotor configured to compress air;

a motor for driving the compressor rotor, the motor and compressor rotor disposed about a common axis, the motor comprising:

a rotor shaft coupled to the compressor rotor and configured to drive the compressor rotor, the rotor shaft comprising a plurality of orifices; and a thrust shaft disposed at an opposite end of the motor from the rotor shaft;

a tie rod disposed on the common axis and extending through the rotor shaft, thrust shaft, and the compressor rotor, the tie rod axially retaining the compressor rotor at a forward end and the motor at an aft end;

a first journal bearing disposed concentrically about the common axis to radially support the rotor shaft, wherein the first journal bearing is disposed about the rotor shaft;

a journal bearing support disposed concentrically about the first journal bearing;

a cooling fluid inlet disposed adjacent to the journal bearing support and in fluid communication with the first journal bearing; and an annular heat shield, the annular heat shield and journal bearing support defining a first cavity therebetween, the first cavity open to the cooling fluid inlet;

wherein the journal bearing support comprises an opening at an inner diameter opening to the first cavity and the journal bearing and the plurality of orifices of the rotor shaft; and wherein the opening is disposed adjacent to a forward end of the first journal bearing.

2. The compressor of claim 1, wherein the journal bearing support comprises a seal plate disposed between the compressor rotor and a radially extending portion of the journal bearing support, the seal plate and the radially extending portion of the journal bearing support defining a second cavity therebetween, the second cavity open to each of the journal bearing, the plurality of orifices of the rotor shaft, and the first cavity.

3. The compressor of claim 2, wherein the second cavity is disposed adjacent to a forward end of the first journal bearing.

4. The compressor of claim 1, and further comprising a first bearing cooling flow path extending axially from a forward end of the first journal bearing to an aft end of the first journal bearing.

5. The compressor of claim 1, wherein the cooling fluid inlet is in fluid communication with an inner diameter of the rotor shaft.

6. The compressor of claim 1, wherein the journal bearing support is configured to divide a cooling fluid received in the cooling fluid inlet between a bearing cooling stream and a rotor cooling stream, the bearing cooling stream having a flow path extending through the first journal bearing, the rotor cooling stream having a flow path extending through an inner diameter of the rotor shaft.

7. The compressor of claim 6, and further comprising a tie rod support disposed between the tie rod and the rotor shaft, the tie rod support comprising a plurality of orifices configured to receive the rotor cooling stream.

8. The compressor of claim 6, wherein the thrust rotor comprises a plurality of radially extending orifices configured to receive a first portion of the rotor cooling stream.

9. The compressor of claim 8, wherein the thrust rotor comprises a plurality of axially extending orifices configured to receive a second portion of the rotor cooling stream.

10. The compressor of claim 9, wherein the compressor further comprises a second journal bearing disposed concentrically about the common axis and the thrust shaft to radially support the thrust shaft, wherein the plurality of radially extending orifices is located forward of the second journal bearing and wherein the second journal bearing is disposed to receive the first portion of the rotor cooling stream, wherein the first portion of the rotor cooling stream is a second bearing cooling stream.

11. The compressor of claim 10, and further comprising first and second thrust bearings disposed adjacent to the thrust shaft to axially support a radially extending thrust runner of the thrust shaft, the first and second thrust bearings disposed on opposite sides of the thrust runner.

12. The compressor of claim 11, wherein the first thrust bearing is disposed to receive the second portion of the rotor cooling stream and the second thrust bearing is disposed to receive the first portion of the rotor cooling stream from the second journal bearing, wherein the first portion of the rotor cooling stream is a third bearing cooling stream.

13. The compressor of claim 12, and further comprising a cooling fluid outlet disposed adjacent to the first and second thrust bearings and configured to receive the first and second portions of the rotor cooling stream from the first and second thrust bearings.

14. The compressor of claim 13, wherein flow paths of the first and second bearing cooling streams and the rotor cooling stream extend axially from a forward to aft direction through the compressor.

15. A method for cooling a compressor having a compressor rotor driven by a motor, wherein the motor and compressor rotor are disposed on a common axis with the compressor rotor arranged forward of the motor, the method comprising:

providing a cooling stream to an inlet disposed at a forward end of the motor;

dividing the cooling stream into:

a first cooling stream directed to a first journal bearing supporting a rotor shaft coupled to the compressor rotor; and a rotor cooling stream directed to an inner diameter of the rotor shaft;

providing a first portion of the rotor cooling stream to a second journal bearing, the second journal bearing supporting a thrust shaft coupled to an aft end of the motor opposite the rotor shaft;

providing the first portion of the rotor cooling stream to a first thrust bearing disposed downstream of the second journal bearing;

providing a second portion of the rotor cooling stream to a second thrust bearing; and combining the first and second portions of the rotor stream in a cooling outlet downstream of the first and second thrust bearings.

* * * * *